US006811501B2

(12) United States Patent
Kuzia et al.

(10) Patent No.: US 6,811,501 B2
(45) Date of Patent: Nov. 2, 2004

(54) FREE-STANDING PARTITIONED GOAL AND PROCESS OF USING THE GOAL

(75) Inventors: Stanley J. Kuzia, Evans, GA (US); Morris M. May, Augusta, GA (US); Lee Wheatley, Augusta, GA (US); Timothy E. Moses, Augusta, GA (US)

(73) Assignee: International Bullseye Sports Association, LLC, Evans, GA (US)

( * ) Notice: Subject to any disclaimer, the term of this patent is extended or adjusted under 35 U.S.C. 154(b) by 0 days.

(21) Appl. No.: 10/226,511

(22) Filed: Aug. 23, 2002

(65) Prior Publication Data

US 2004/0038759 A1 Feb. 26, 2004

(51) Int. Cl.[7] ..... A63B 67/00; A63B 69/00

(52) U.S. Cl. ..... 473/478; 473/422; 473/434; 473/197; 473/172

(58) Field of Search ..... 473/197, 172, 473/150, 421, 422, 434, 435, 446, 449, 454, 470, 471, 476–478, FOR 104, 116, 212; 273/348, 331, 378, 381, 382, 389, 402–408, 410

(56) References Cited

U.S. PATENT DOCUMENTS

| | | | | |
|---|---|---|---|---|
| 1,527,988 A | | 3/1925 | McMurtrie | |
| 1,785,150 A | * | 12/1930 | Soubier et al. | 473/137 |
| 1,923,152 A | | 8/1933 | Kohn | |
| 2,450,125 A | | 9/1948 | Dunfee | |
| 2,899,208 A | * | 8/1959 | Wallsteiner | 473/194 |
| 3,580,578 A | | 5/1971 | McCarthy | |
| 3,822,883 A | | 7/1974 | De Vos | |
| 3,856,298 A | | 12/1974 | Frantti | |
| 4,083,562 A | * | 4/1978 | Zepper | 473/478 |
| 4,188,031 A | | 2/1980 | Fox | |
| 4,254,952 A | | 3/1981 | Playter, Jr. | |
| 4,492,380 A | | 1/1985 | Saytar | |
| 4,664,384 A | * | 5/1987 | Solla | 473/478 |
| 4,796,886 A | | 1/1989 | Loh | |
| 5,280,904 A | * | 1/1994 | Rodriguez | 473/477 |
| 5,290,043 A | | 3/1994 | Vidinic | |
| 5,524,901 A | * | 6/1996 | Bison et al. | 473/197 |
| 5,672,125 A | * | 9/1997 | Ross | 473/421 |
| 5,830,089 A | * | 11/1998 | Halter et al. | 473/478 |
| 5,993,334 A | * | 11/1999 | McNamara | 473/446 |
| 6,579,196 B1 | * | 6/2003 | Yoon | 473/421 |
| 2004/0072635 A1 | * | 4/2004 | Clark | 473/478 |

FOREIGN PATENT DOCUMENTS

| | | | | |
|---|---|---|---|---|
| CA | 1207-811 A | * | 7/1986 | 473/FOR 132 |

* cited by examiner

*Primary Examiner*—Mitra Aryanpour
(74) *Attorney, Agent, or Firm*—Dority & Manning, P.A.

(57) ABSTRACT

A free-standing partitioned goal and games using the goal is provided. The goal is divided into a series of partitions formed by internal net dividers. The front edge of each partition is secured by an interwoven or integral elastic cord carried by a front edge of the partition. The resilient partitions retain balls which are kicked therein, each partition having assigned to it possible varying point values which facilitate training as well as specific games directed to using the goal.

16 Claims, 6 Drawing Sheets

FREE-STANDING PARTITIONED GOAL AND PROCESS OF USING THE GOAL

FIELD OF THE INVENTION

This invention is directed towards a free-standing goal for use with kicking games such as soccer. The goal allows for games and training exercises which increase a user's kicking accuracy and further provides an enhanced level of interaction and excitement on the part of players and spectators.

BACKGROUND OF THE INVENTION

Recreational games are well known in which points are awarded for securing a ball or other object within the goal. Games using such goals include soccer, ice hockey, field hockey, street hockey, polo, and water polo. In games such as soccer, an important aspect of scoring involves accurate placement of the ball within the defined goal area. In particular, soccer is a fast moving game which requires a player to rapidly control and accurately place a ball within the goal dimensions.

There are a variety of goal and goal game apparatuses known within the art. For instance, U.S. Pat. No. 2,450,125 discloses a goal in which golf balls are driven into a divided net region. A point system is used to award points based upon the accuracy of the balls driven into the net.

U.S. Pat. No. 3,822,883 also discloses a target game using a net in which the net is divided into three compartments. The described game awards variable points depending upon the placement of balls which are directed into relative positions within the net.

U.S. Pat. No. 4,188,031 is directed to a multi-sport practice goal having adjustable crossbars which may be used to vary the size and spacing of openings to the net. The crossbars extend only across the opening of the goal/net and do not divide the interior of the net into separate partitions.

U.S. Pat. No. 5,290,643 provides for a target for improving soccer skills in which a flat panel defines a plurality of colored point squares. Points are awarded based upon accuracy of the kick within the squares.

While a variety of goals and practice targets are known, there remains room for improvement and variation within the art.

SUMMARY OF THE INVENTION

It is one aspect of one of the present embodiments of this invention to provide a goal which facilitates accuracy in the placement of one's shots on goal.

It is yet another aspect of at least one of the present embodiments to provide a goal for a ball kicking game in which a player is rewarded for a successful score by receiving acoustic feedback, the acoustic feedback being provided by a rear panel or ball stop which is designed to reverberate when struck by a ball.

It is yet another aspect of at least one of the present embodiments to provide a goal having a plurality of divided partitions, each partition representing a separate goal and/or scoring opportunities and for which varying point values may be assigned.

It is yet another aspect of at least one of the present embodiments of the invention to provide a goal for a ball kicking game which prominently displays advertising of a sponsor or merchant.

It is yet another aspect of at least one of the present embodiments of the invention to provide a goal for a ball kicking game which incorporates an advertising message into the acoustic feedback structure which increases the visibility and prominence of the advertisement.

It is yet another aspect of at least one of the present embodiments to provide a goal for a ball kicking game which may be easily transported and utilized in both outdoor and indoor playing environments.

It is yet another aspect of at least one of the present embodiments to provide a goal for a ball kicking game in which a player is challenged to place accurate shots in the absence of a goalie or other defensive player.

It is yet another aspect of at least one of the present embodiments to provide a novel goal and novel games using the goal, such games including individual and team games of skill, coordination, and timing.

These features may be provided by a goal for a ball kicking game comprising a free standing frame; a top defined by the frame, the top having a width and a length; a base, defined by the frame, the base substantially parallel to the top, the base having a width substantially the same as a width of the top, the base further defining a length greater than a length of the top; a pair of rear wall members, the rear wall members spaced apart a distance substantially the same as a width of the base, the pair of rear wall members connecting a back edge of the base to a back edge of the top; and, a pair of front wall members, the front wall members spaced apart a distance substantially the same as a width of the base, the pair of front wall members connecting a front edge of the base to a front edge of said top. Additionally, the goal includes an acoustic panel in proximity to a rear of the goal, the acoustic panel adapted for generating a loud noise when struck by a ball. Further, the goal opening also includes at least two partitions, the partitions formed on opposite sides of a piece of netting, the piece of netting extending vertically from an opening of the goal to the rear of the goal, the netting secured along a front edge by an elastic cord, said netting thereby forming a resilient barrier between at least two partitions. Each partition is sufficiently resilient such that a ball striking the partition will land in a scoring section as opposed to rebounding back into the playing field. This ability enhances the scoring opportunities by maximizing the frequency of balls landing within the scoring area.

These and other features, aspects, and advantages of the present invention will become better understood with reference to the following description and appended claims.

BRIEF DESCRIPTION OF THE DRAWINGS

A fully and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures or embodiments, although such apparatus or process is labeled with the same reference numbers.

Figure 1:
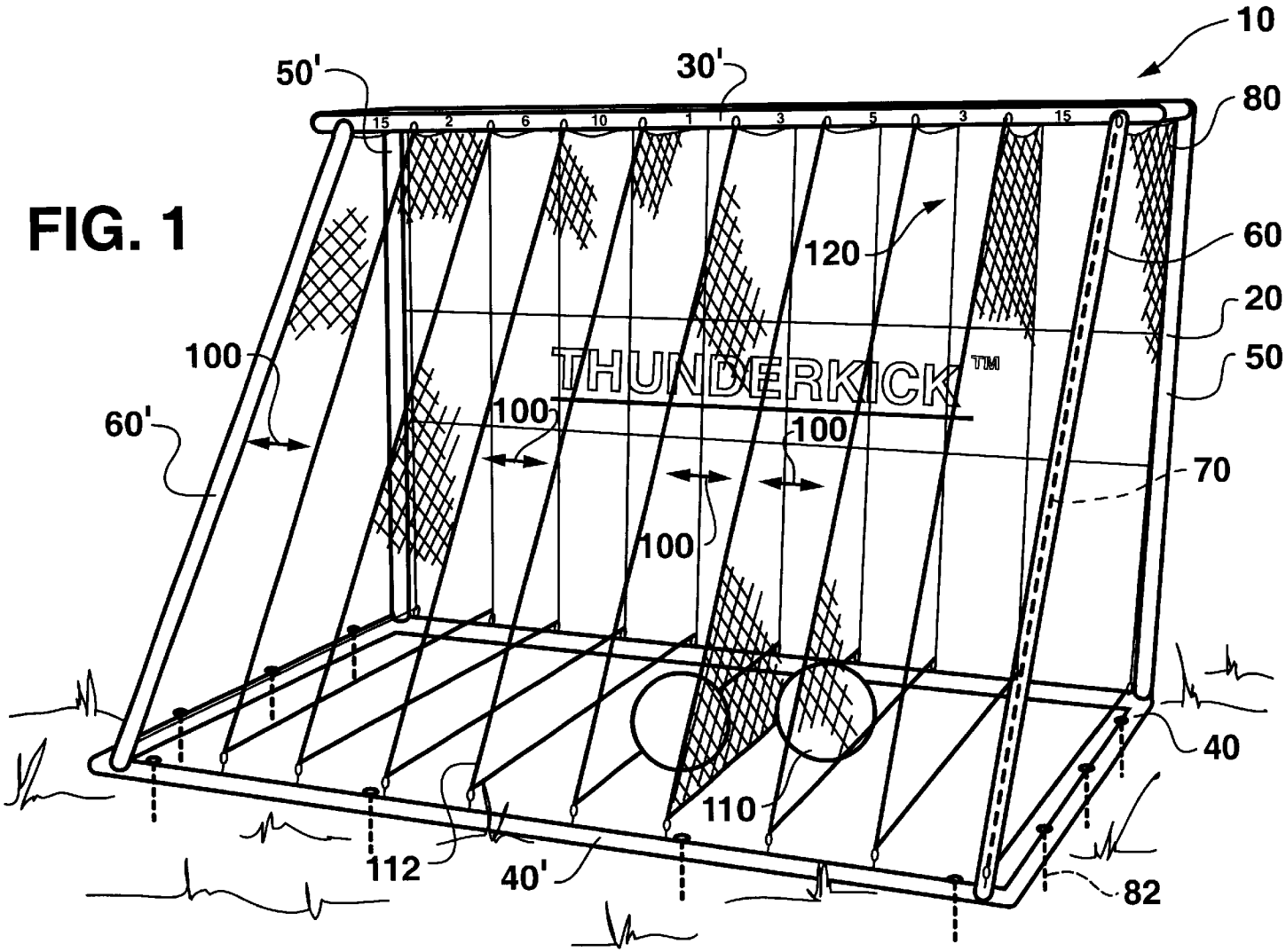
FIG. 1 is a front perspective view of one embodiment of a goal in accordance with the present invention.
Figure 2:
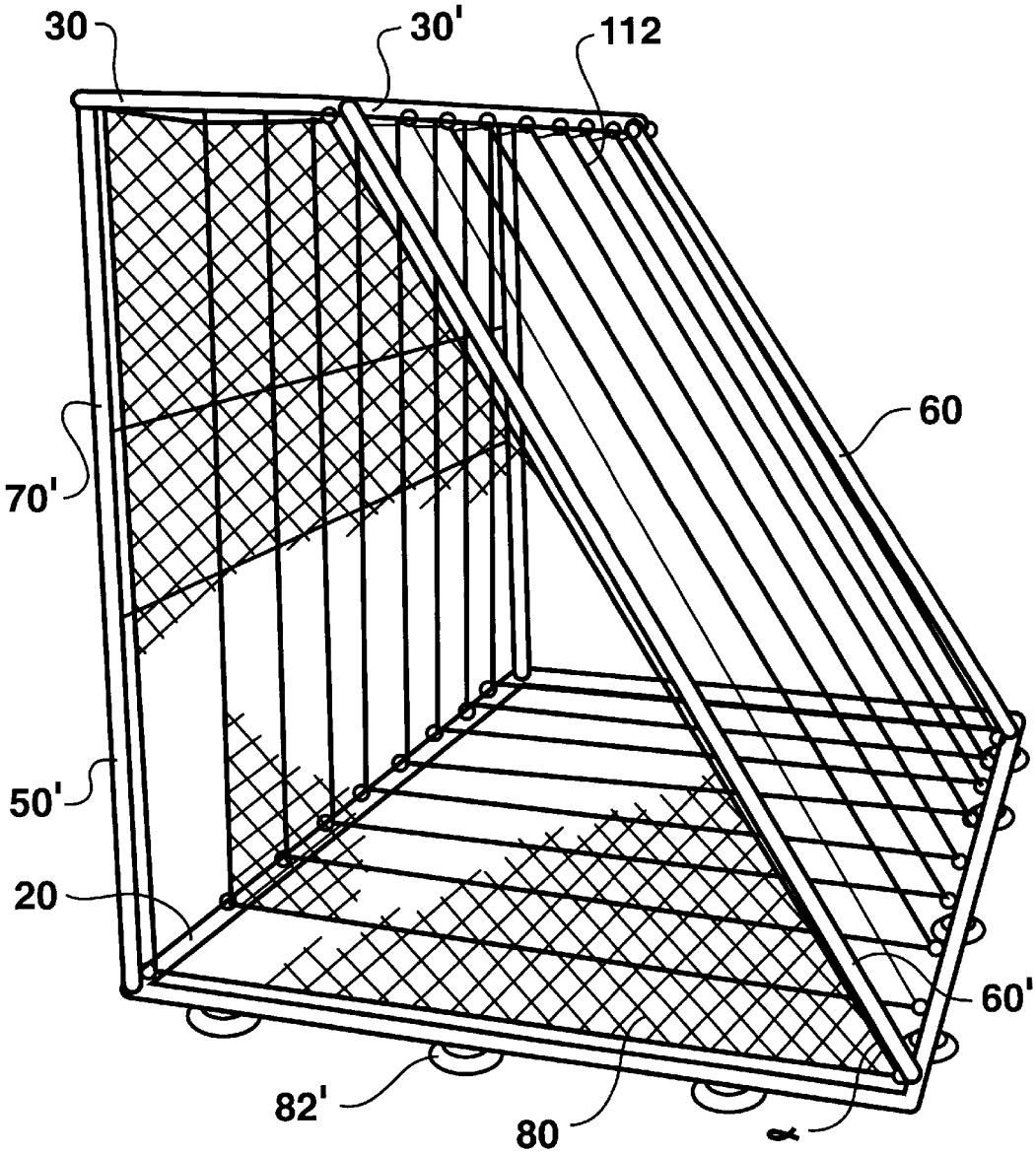
FIG. 2 is a side perspective view of the goal seen in FIG. 1, setting forth an alternative fastener system
Figure 3:
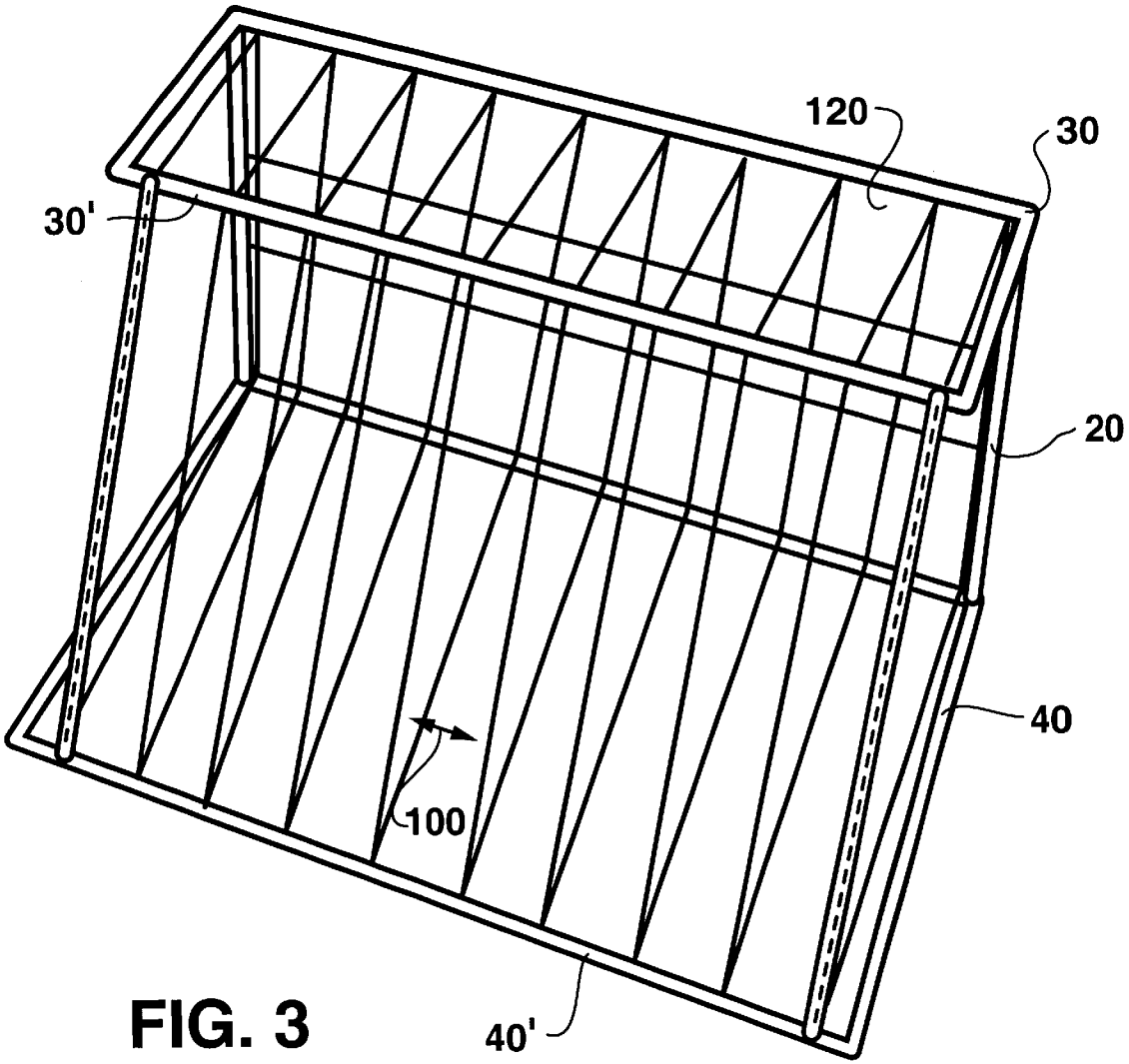
FIG. 3 is a perspective schematic view of the goal seen in FIG. 1 illustrating additional aspects of the invention.
Figure 4:
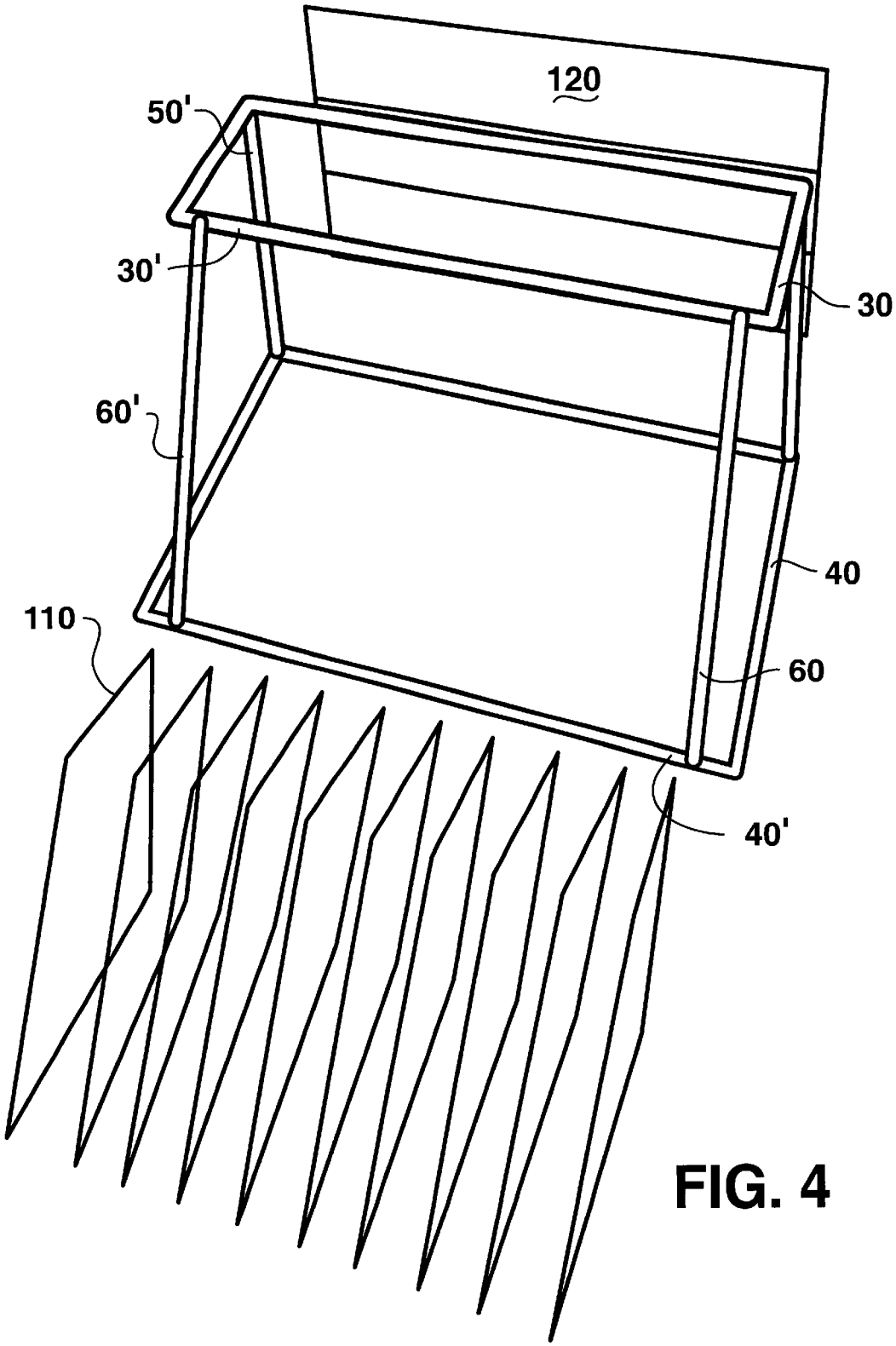
FIG. 4 is an exploded view of the goal seen in FIG. 3.

As best seen in reference to FIGS. 1 through 3, a free-standing goal 10 is illustrated. Goal 10 may be constructed of a plurality of frame elements 20 seen here in the form of pipes or tubing. The frame elements 20 can be provided from a variety of materials and may include materials such as plastic metal, wood, fiberglass, or composite materials. Such materials may be provided in a variety of shapes. For instance, the frame elements 20 could be selected from the above materials and have a structural shape of a rectangular, triangular, square, round, or other design or combinations of structural designs and which offer sufficient strength, durability, resilience, and desired weight.

The frame elements 20 are combined to form a rectangular top 30 (FIG. 3) which is positioned parallel to and above a rectangular base 40. The top 30 and base 40 are connected along a rear of the goal by a pair of rear supports 50 and 50'. The rear supports 50 and 50' are spaced apart substantially the same distance as a width of the top 30 or base 40. As best seen in reference to FIG. 3, the rear members 50 and 50' are joined at substantially right angles to corresponding rear corners of top 30 and to the rear corners of base 40.

As best seen in FIG. 1, front frame supports 60 and 60' connect the front frame element 30' of top 30 to the front frame element 40' of base 40. Since base 40 has a greater length than top 30, the front support members 60 and 60' are angled toward a rear of the goal at an included angle $\alpha$ of about 60°. The goal 10 further defines a first side 70 and a second side 70'. Each side 70 and 70' are formed from the previously identified frame components including elements from the top, the base, the rear members, and the front supports.

As seen in reference to FIGS. 1 and 2, each side 70 and 70' along with the top 30 have their respective openings secured by a mesh covering 80. The mesh covering is preferably in the form of a conventional net material such as a nylon or synthetic netting commonly employed in a conventional soccer goal. However, it is envisioned that other mesh materials could be employed.

As best seen in reference to FIGS. 1 and 2, base 40 may further define a series of fasteners which may be used to prevent movement of the goal. The fasteners 82 may be in the form of tethered spikes or stakes (FIG. 1) which may be driven into a playing field. Alternatively, fasteners 82' (FIG. 2) could be in the form of a suction cup which may be used to secure the goal to an indoor floor. Alternatively, the goal may be supported by retractable or lockable wheels suitable for use on a gym floor or a series of pads to support the goal. Additionally, it is envisioned that the goal may be readily disassembled into smaller component parts or constructed in a manner which folds into a more compact shape for storage or transportation.

Instead of the optional fasteners 82, it is also envisioned that the hollow frame members, particularly the components of base 40, may be reversibly filled with sand, water, or other filler to increase the weight and stability of the goal.

Goal 10 preferably defines at least one internal partition 100. In reference to FIG. 1, partition 100 is formed by a piece of vertically extending mesh 110, mesh 110 forming an insert having a size and shape which corresponds to the dimensions of sides 70 and 70'. Extending along a front edge of partition 100 is an elastic cord 112.

Figure 5:
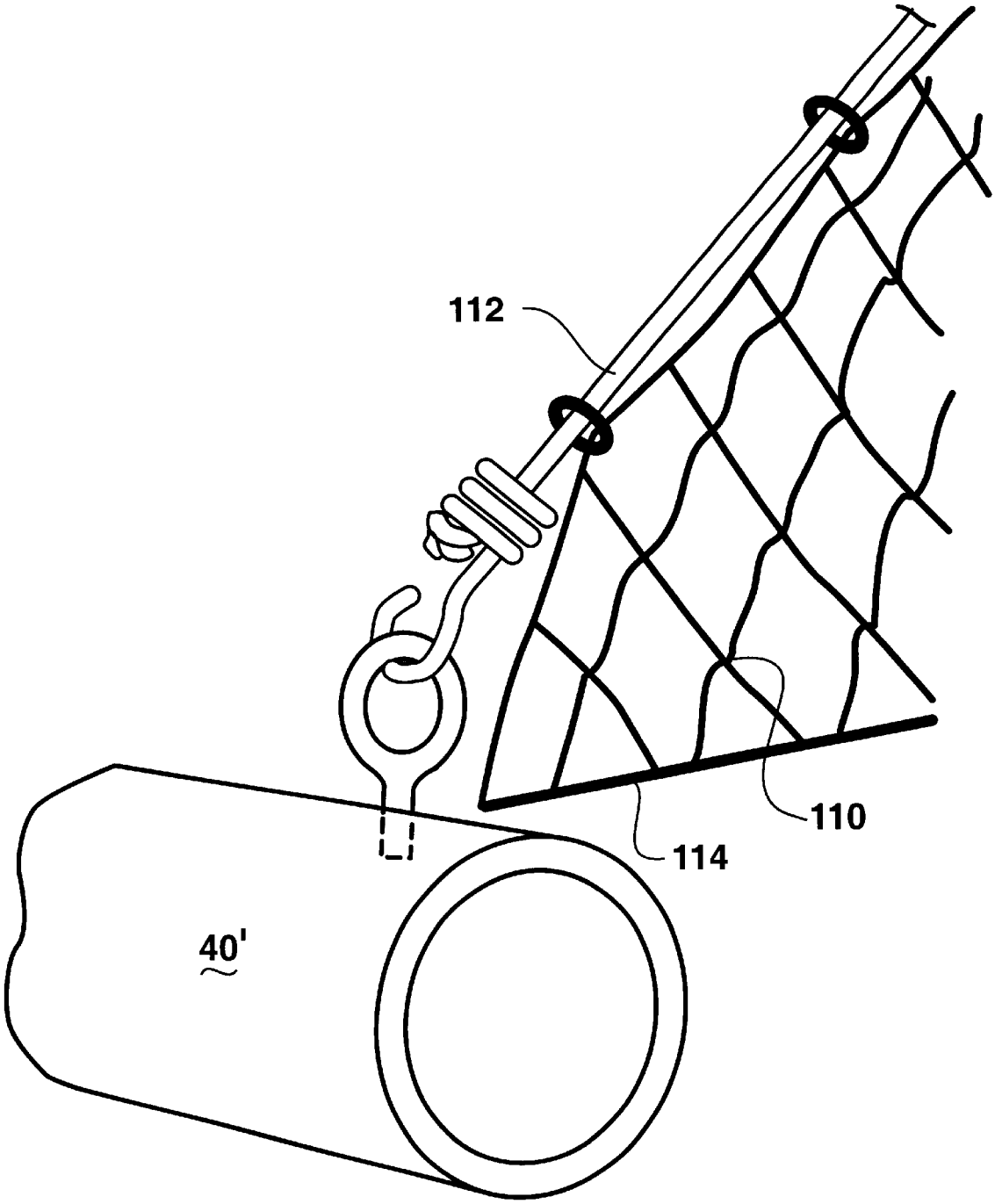
FIG. 5 is a close-up view of a front edge of a partition attached to the base of the goal.

As seen in FIG. 5, cord 112 may be secured in a tensioned arrangement to eye hooks or other holdfasts which are attached to or formed within the front portion of top 30 and base 40. The elastic cord 112 is integral with the netting either by weaving the cord into alternating portions of the mesh or physically securing the cord to a border of the mesh 110. The resulting elastic properties of the partitions provide for a resiliency to the partitions which facilitates the retention of balls within the partition. As a result, a greater percentage of the balls are retained within the partitions than would otherwise occur with a non-resilient partition. The additional perimeter of mesh divider 110 defines a reinforced edge which may be provided by an increased thickness in the mesh perimeter or through the interweaving of a rope or cord 114 along the bottom, rear, and upper edges of mesh insert 110.

As seen in the illustrated embodiments, a plurality of equally spaced partitions 100 may be formed by the use of similar mesh 110 inserts. Each mesh 110 insert extends vertically into the interior of the goal with each respective cord 112 of the front edge being aligned in a plane substantially parallel to a plane defined by the front supports 60 and 60'.

Figure 6:
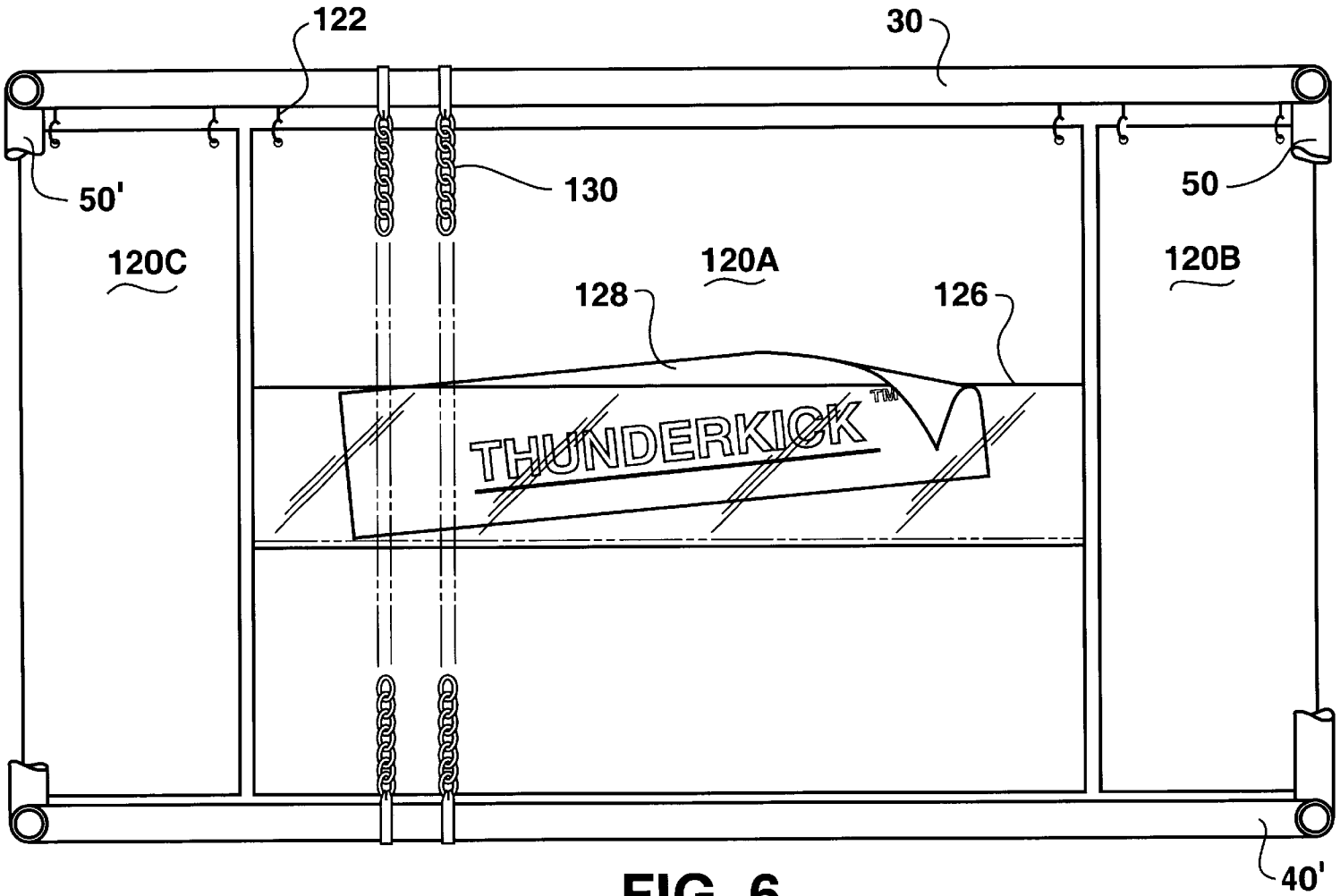
FIG. 6 is a perspective view of the acoustic backstop setting forth alternative embodiments of the backstop construction.

Goal 10 further defines a rear surface panel 120 as seen here in the form of a piece of sheet metal. As seen in FIG. 6, rear panel 120 may be suspended from the rear edge of top 30 by two or more supports 122 which may be provided by chains, straps, or circular eye bolts, and thereby provide a backstop with respect to balls entering the goal. Panel 120, when attached to the goal 10 as described, is able to reverberate and produce a loud sound, similar to a gong. If needed, additional attachment sizes may be provided along a bottom or edge of the panel. It is preferred that the nature of panel attachments are such that the sound producing capabilities of panel 120 are emphasized.

The rear panel 120 is selected from sheet metal, fiberglass, opaque plastic, transparent plastic, or some other acoustic material such that when the panel is struck by a ball, the panel resonates and generates a loud noise. It is also envisioned that the acoustic material of rear panel 120 may be provided by a transparent plastic sold under the trademark PLEXIGLAS™. In keeping with the present invention, it is desirable to generate a loud noise from the rear panel whenever struck by a ball. The noise serves as a recognition and reinforcement to both the player and spectators that a well placed ball has found its target. The noise and reverberation adds an exciting element to both practices and games.

While rear panel 120 is shown in FIG. 1 as a single panel, a plurality of smaller panels (FIG. 6) could be used to form the rear backstop. For instance, a large central panel 120A could be used as a backstop for the central partitions extending across the middle of the goal. Separate individual panels 120B and 120C could be used adjacent the main panel, each separate panel corresponding to one or more of the outermost partitions. In this manner, when the outermost panels are struck, a different, higher pitched sound is generated and is indicative of a higher point value. As seen in reference to FIG. 1, each partition may be provided with a varying point value as indicated along the front element of top 30. As seen in FIG. 1, point values may vary depending upon which partition "target" is accessed. Accordingly, it may be possible to vary the sound generated from the rear panel(s) 120 in keeping with the awarded point value.

The rear panels may also be supplemented or replaced in whole or in part by a series of lengths of chains 130 which hang vertically from the rear of the goal. The chains serve a dual function of providing a backstop for the ball and varying the type of noise associated with a ball striking the rear portion of the goal. For instance, the chain 130 may additionally strike against the rear acoustic panel, providing additional acoustic feedback over and above the sound made by a ball striking only the acoustic panel. In addition to vertical chains, other vertical noise makers such as ropes having a plurality of bells, or other noise makers, may also be used.

If desired, the acoustic panel may be enhanced by the addition of electronic noise amplifiers and may optionally be integrated into an existing sound system or public address system of the recreational facility. Such enhancements may range from simple amplification of the existing acoustic panel to triggering an electronic sound or signal when an appropriate sensor associated with the acoustic panel is activated by a ball. A visible portion of the acoustic panel may include an electronic sign or display which illuminates a message when a score is detected. Through the use of the electronic sensors and enhancements, each partition could signal through a different tone or visual display varying sounds which correlate to varying point values. One having ordinary skill in the relevant art could incorporate the electronic detectors and signaling capability into an automatic scoreboard which may be remote from the goal or integrated into the goal and/or acoustic panel.

Each partition 100 has sufficient rigidity such that a ball entering the partition at a high velocity will be retained within the respective partition. In addition, the panel 120 has sufficient mass and/or restraints to prevent a ball from escaping along a side or bottom edge of the panel. This ability facilitates the scorekeeping and lends itself to additional games and training exercises that are set forth below.

As seen in reference to the Figures, the front edge of the base 40 is elevated relative to the playing surface. The elevated surface provides a lip which may be varied in height if desired and is designed to prevent balls from merely rolling into the goal. Instead, a more forceful and elevated kick is required and which thereby generates an acoustic response from the rear panel as a more forceful or airborne shot is received.

Panel 120 is also adapted for displaying promotional materials and advertising on both the front and rear sides of the panel. Such advertising may be a permanent part of the panel, though it is envisioned that the advertising material may be easily removed and attached to panel 120. For instance, magnetic signs, or peelable adhesive sheets may be used to position advertising on the panel. Additionally, conventional clips or other holders could be used to secure vinyl banners or other conventional signage to the panel. Holders may include a plastic panel or two piece sleeve 126 attached to the panel 120 and through which a provided sign 128 may be inserted as seen in reference to FIG. 6.

The advertising material may be applied along any visible location of the acoustic panel 120. In addition, the outer surface of sides 70 and 70' of the goal could be equipped with transparent plastic panels which would support various forms of advertising media or strips. The transparent side panels would permit visibility on behalf of spectators while supporting advertising signage. In addition, the side panels could be in the form of colored acrylic or PLEXIGLAS™ in which a corporate logo or sponsor message appears in a color transparent medium. This ability also preserves visibility of spectators while still presenting an advertising opportunity for a sponsor or other vendor.

The present invention offers a goal which has several unique features. The goal may be used in an individual or team game of skill in which opposing players or teams earn points based upon placement of a game ball or balls within the goal. The goal also provides a useful training tool where a soccer player may practice precise placement of kicks within the various partitions 100 defined by the divider nets. Additionally, both games and practice take on a new and interesting dimension by virtue of the acoustic panel which serves as a backstop to the goal. The goal is a free-standing unit that can be easily moved and repositioned and has utility for both inside and outside uses.

It is also envisioned that the shape and dimensions of the goal may be varied depending upon the available playing space as well as variations in size to accommodate variations in the ages and skill levels of players. For instance, a smaller size which may include a fewer number of partitions may be developed for use in a garage or small gymnasium. Larger sizes may be used with more spacious indoor arrangements or use in a larger playing field or stadium. Accordingly, the present invention envisions that differences in relative sizes, number of partitions, and dimensions may be used in keeping with the present invention. For example. a partition width of 9 inches or greater Additionally, the goals may be constructed to allow for disassembly or folding to assist in transportation and storage.

The goal 10 lends itself to a variety of games which may be used for team play or as an individual training tool. Such games are described below:

Game 1—"High Score"

The "High Score" game takes advantage of the varying point values within the 9 partitions as seen in the illustrated embodiment. As seen in reference to FIG. 1, point values range from a low of 1 point for a center partition shot to a high of 15 points for shots which are placed in either the furthest left or the furthest right partition. Each player is permitted 10 kicks from a pre-determined distance. The winner is the player with the highest score. In the illustrated embodiment, 150 points would represent a perfect score.

Game 2—"The Fill"

In this game, a player attempts to fill all 9 partitions before a partition is used twice. This game requires increasing accuracy as the game proceeds. The player who fills the largest number of partitions without a repeat or a miss is declared the winner.

Game 3—"Rotation"

This training game involves a player making consecutive kicks in sequence going from left to right. This game helps develop a high skill and shot accuracy and the precise placement of a player's kicks.

Game 4—"Fireball™" is a team game using 4 to 6 players per team. Each team uses one player at a time with the object of each player to score in 7 of the 9 partitions as rapidly as possible. Each partition or score counts as one point with the team total at the end of 4 minutes determining the winner. Each player is positioned a set distance from the goal and a team "feeder" provides balls for the shooter.

Game 5—"Kicker" Team Game

An additional team game using the goal of the present invention involves teams having 4 to 6 players per team. Each team is in competition with another team during a match consisting of three 5-minute periods. Each team sequentially uses 2 players at a time in rotation. The first player will dribble the ball from midfield until he/she crosses a predetermined passing line. The first player must then pass the ball to the shooter who must acquire and shoot the ball prior to the ball passing a shooting line. Points are awarded based upon indicated point values as placed above each goal partition. Upon either scoring or missing the shot, both players return to their team line to prepare for their next turn. At the end of the match, the team with the highest score is declared the winner. In this game, the distance from the goal of the shooting line or the passing line may be varied depending upon the age and skill of the players involved.

As seen in reference to the above described goal and the accompanying games, the present invention facilitates individual and team practice and games which reward players through a system of varying points based upon the skill and accuracy of their shots. An added dimension of the game involves the immediate feedback and excitement of the acoustic panel. The acoustic panel has benefits for both the players and the spectators. In addition, the nature of the backstop/rear panel is such that promotional advertising may be used on the goals. Heretofore, recreational soccer fields and indoor soccer games lacked an ability to present meaningful advertising opportunities for various sponsors. The present invention provides for this advertising opportunity while simultaneously adding a new and exciting acoustic element to practice and games.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed:

1. A goal for a ball kicking game comprising:

a free standing frame;

a top defined by said frame, said top having a width and a length;

a rectangular base defined by said frame, said rectangular base substantially parallel to said top and configured for contact with the ground, said rectangular base having a width substantially the same as a width of said top, said rectangular base further defining a length greater than a length of said top, said rectangular base having a front frame element;

a pair of rear wall members, said rear wall members spaced apart a distance substantially the same as a width of said base, said pair of rear wall members connecting a back edge of said base to a back edge of said top;

a pair of front wall members, said front wall members spaced apart and said pair of front wall members connecting a front edge along said front frame element to a front edge of said top;

a plurality of dividers, each divider comprising a piece of netting have a front edge defining an elastic member, said elastic member extending from said top to said front frame element, each said divider further extending into an interior of said goal, each pair of adjacent dividers thereby forming a partition for retaining a ball therein; and a backstop positioned along a rear of said goal, said backstop comprising at least one acoustic panel.

2. The goal according to claim 1 wherein said free-standing frame further defines a first open side and a second open side, said first open side and said second open side each further defining a respective mesh covering each said respective opening.

3. The goal according to claim 2 wherein said top of said frame further defines a net extending across an opening defined by said top.

4. The goal according to claim 1 wherein said goal further defines an acoustic panel in proximity to a rear of said goal, said acoustic panel adapted for generating a loud noise when struck by a ball.

5. The goal according to claim 4 wherein said acoustic panel is suspended from a rear edge of said top.

6. The goal according to claim 5 wherein said acoustic panel further comprises a piece of sheet metal.

7. The goal according to claim 1 wherein a goal opening defines at least two partitions, said partitions formed on opposite sides of a piece of netting, said piece of netting extending vertically from an opening of said goal to said rear of said goal, said netting secured along a front edge by an elastic cord, said netting thereby forming a resilient barrier between said at least two partitions.

8. The goal according to claim 7 wherein a plurality of pieces of netting are spaced across said opening, each of said plurality of pieces of netting extending vertically from said opening of said goal to said rear of said goal, thereby forming a plurality of partitions.

9. The goal according to claim 8 wherein each of said plurality of partitions has substantially the same width.

10. The goal according to claim 8 wherein each of said partitions has a width of at least about 9 inches.

11. The goal according to claim 7 wherein said piece of netting has a size and a shape substantially conforming to the size and shape of an edge of said goal.

12. The goal according to claim 11 wherein said piece of netting is interwoven along at least its front edge by an elastic cord.

13. The goal according to claim 4 wherein said acoustic panel provides a display surface for the placement of advertising.

14. The goal according to claim 4 wherein said acoustic panel is selected from materials consisting of sheet metal, fiberglass, opaque plastic, transparent plastic, and combinations thereof.

15. A kicking game for practicing soccer skills comprising:

a goal, said goal having a rectangular opening defined by a frame, said rectangular opening further defined by a top frame element, a rectangular bottom frame element, a first front frame element, and a second front frame element, including a front frame element configured for contact with the ground said first and said second front frame support extending in a rearward direction from said bottom frame element to said top frame support, said first and second front frame supports extending from said frame front element at an approximate 60 degree included angle;

a plurality of dividers, each divider comprising a piece of netting have a front edge defining an elastic member, said elastic member extending from said top frame element to said frame front element, each said divider further extending into an interior of said goal, each pair of adjacent dividers thereby forming a partition for retaining a ball therein, each partition having a point value assigned thereto;

a backstop positioned along a rear of said goal, said backstop comprising at least one acoustic panel, said acoustic panel adapted for generating a loud noise when struck by a soccer ball; and wherein a player is awarded points for kicking a ball into at least one of said partitions.

16. A goal for a ball kicking game comprising:

a goal, said goal having a rectangular opening defined by a frame, said rectangular opening further defined by a top frame element, a rectangular bottom frame element, a first front frame support, and a second front frame element including a front frame element configured for contact with the ground said first and said second front frame support extending in a rearward direction from said bottom frame element to said top frame support, said first and second front frame elements extending from said frame front element at an approximate 60 degree included angle;

a plurality of dividers, each divider comprising a piece of netting have a front edge defining an elastic member, said elastic member extending from said top frame element to said bottom frame element, each said divider further extending into an interior of said goal, each pair of adjacent dividers thereby forming a partition for retaining a ball therein, each partition having a point value assigned thereto; and, a backstop positioned along a rear of said goal, said backstop comprising at least one acoustic panel, said acoustic panel adapted for generating a loud noise when struck by a soccer ball.

* * * * *

UNITED STATES PATENT AND TRADEMARK OFFICE

CERTIFICATE OF CORRECTION

PATENT NO. : 6,811,501 B2
DATED : November 2, 2004
INVENTOR(S) : Kuzia et al.

It is certified that error appears in the above-identified patent and that said Letters Patent is hereby corrected as shown below:

Column 9,
Lines 1-29, cancel the text beginning with "15. A kicking game" to and ending "said partitions.", and insert the following claim:
15. A kicking game for practicing soccor skills comprising:

a goal, said goal having a rectangular opening defined by a frame, said rectangular opening further defined by a top frame element, a rectangular bottom frame element including a front frame element configured for contact with the ground, a first front frame support, and a second front frame support, said first and said second front frame supports extending in a rearward direction from said front frame element to said top frame element, said first and second front frame supports extending from said front frame element at an approximate 60 degree included angle;
a plurality of dividers, each divider comprising a piece of netting have a front edge defining an elastic member, said elastic member extending from said top frame element to said bottom frame element,
each said divider further extending into an interior of said goal, each pair of adjacent dividers thereby forming a partition for retaining a ball therein, each partition having a point value assigned thereto;
a backstop positioned along a rear of said goal, said backstop comprising at least one acoustic panel, said acoustic panel adapted for generating a loud noise when struck by a soccer ball, and
wherein a player is awarded points for kicking a ball into at least one of said partitions.

Column 10,
Lines 1-26, cancel the text beginning with "16. A goal for a ball" to and ending "by a soccor ball.", and insert the following claim:
16. A goal for a ball kicking game comprising:

a goal, said goal having a rectangular opening defined by a frame, said rectangular opening further defined by a top frame element, a rectangular bottom frame element including a front frame element configured for contact with the ground, a first front frame support, and a second front frame support, said first and said second front frame supports extending in a rearward direction from said front frame element to said top frame element, said first and second front frame supports extending from said front frame element at an approximate 60 degree included angle;
a plurality of dividers, each divider comprising a piece of netting having a front edge defining an elastic member, said elastic member extending from said top frame element to said bottom frame element, each said divider further extending into an interior of said goal, each pair of adjacent dividers thereby forming a partition for retaining a ball therein, each partition having a point value assigned thereto; and
a backstop positioned along a rear of said goal, said backstop comprising at least one acoustic panel, said acoustic panel adapted for generating a loud noise when struck by a soccer ball.

Signed and Sealed this

Nineteenth Day of July, 2005

JON W. DUDAS
*Director of the United States Patent and Trademark Office*